US005983495A

United States Patent [19]

Popoola et al.

[11] Patent Number: 5,983,495

[45] Date of Patent: Nov. 16, 1999

[54] METHOD OF MAKING SPRAY-FORMED INSERTS

[75] Inventors: Oludele Olusegun Popoola, Grand Blanc; Larry Van Reatherford, Clarkston; Robert Corbly McCune, Southfield; Armando Mateo Joaquin, Rochester Hills; Eddie Lee Cartwright, Southfield, all of Mich.

[73] Assignee: Ford Global Technologies, Inc., Dearborn, Mich.

[21] Appl. No.: 08/999,247

[22] Filed: Dec. 29, 1997

[51] Int. Cl.[6] ..... B23P 15/00

[52] U.S. Cl. ..... 29/890.122; 29/527.6; 164/46

[58] Field of Search ..... 29/890.122, 527.6; 164/46, 132

[56] References Cited

U.S. PATENT DOCUMENTS

| | | | |
|---|---|---|---|
| 3,340,084 | 9/1967 | Eisenlohr . | |
| 4,424,953 | 1/1984 | Takagi et al. | 29/890.122 |
| 4,671,491 | 6/1987 | Kuroishi et al. . | |
| 5,060,713 | 10/1991 | Reichelt et al. | 164/46 |
| 5,110,631 | 5/1992 | Leatham et al. . | |
| 5,126,529 | 6/1992 | Weiss et al. | 164/46 |
| 5,505,988 | 4/1996 | Tanskanen et al. . | |
| 5,592,927 | 1/1997 | Zaluzec et al. . | |
| 5,658,506 | 8/1997 | White et al. . | |
| 5,817,267 | 10/1998 | Covino et al. | 164/46 |

OTHER PUBLICATIONS

SAE Technical Paper 820233—Developments in Sintered Valve Seat Inserts—M. S. Lane and P. Smith.

SAE Technical Paper 810237—Sintered Materials With New Concept For Valve Seat–With and Without Cobalt—Nakata et al.

SAE Techniical Paper 880668—Sintered Valve Seat Insert For High Performance Engine—Mineo Onoda and Nobuhito Kuroishi.

SAE Technical Paper 920570—New Pm Valve Seat Insert Materials For High Performance Engines—Akira Fujiki and Makoto Kano.

*Primary Examiner*—Irene Cuda
*Attorney, Agent, or Firm*—Joseph W. Malleck

[57] ABSTRACT

Method of making seat inserts by thermally spraying bulk material. The method includes the steps of: (i) preparing a mandrel having an outside dimension not greater than the desired inside dimension of the desired insert, the mandrel having a part to provide for separation of the sprayed bulk material from the mandrel, (ii) thermal spraying separate particles of one or more types of steel or nickel alloys in the presence of a controlled oxidizing medium to form a bulk composite material on the mandrel with a density of at least 99% and, (iii) after cooling the bulk material, removing such material from the mandrel and slicing it into discrete seat shapes for implanting into the final product.

11 Claims, 4 Drawing Sheets

METHOD OF MAKING SPRAY-FORMED INSERTS

BACKGROUND OF THE INVENTION

1. Technical Field

This invention relates to the technology of spray-forming bulk materials to create objects, and more particularly to making high-performance inserts without chemistry constraints using spray-forming techniques.

2. Discussion of the Prior Art

Inserts have been used to enhance the physical characteristics of certain parts of a component, particularly components in an automotive engine. For example, steel alloy valve seat inserts are used extensively in aluminum engine heads and in some high-performance or alternative fuel cast iron engine heads. The list of enhanced high-performance characteristics desired at the seat is often quite long, including increased ambient and high temperature wear resistance, higher creep resistance, higher thermal fatigue strength, (under repeated valve impact loading), better thermal conductivity, better corrosion resistance, lower manufacturing costs, and capability of being tribologically compatible with valve materials engaging the insert.

A common manufacturing approach that attempts to attain these characteristics is to make the inserts by powder metallurgy processes which involve several steps: weighing and blending of selected powder mixtures; compaction and green body formation in molds and dies; sintering and sometimes copper infiltration of the compact at respectively 1080° C. and 1500° C.; controlled cooling; post-sintering tempering heat treatment; and finally machining to the desired seat dimensions. This obviously is an involved process which adds considerable cost. To achieve the desired physical characteristics, chemical additions are made to the powder mixture of carbon, chromium, molybdenum (for wear resistance), cobalt and nickel (for heat resistance), and other additions to obtain better thermal conductivity or better self-lubrication. In ferrous based powder mixtures, the resulting product may have its matrix consist of pearlite, bainite or tempered martensite depending on the heat treatment used during compacting and sintering. The sintered insert will always have the same chemistry as the starting green compact with its micro-structure dependent on the heat treatment employed.

To obtain more optimum physical characteristics in inserts, very high concentration of certain additions (i.e. 15–25% wt. Cobalt; up to 20% wt. Pb) may be necessary, as well as the introduction of certain chemical ingredients, such as rare earths, which, unfortunately, inhibit or prevent sintering by powder metallurgy techniques. Moreover, powder metallurgy does not allow the introduction of low cost oxides or ceramics during processing; ceramics are very useful to achieve certain of the physical characteristics.

When an engine is run with alternate fuels such as natural gas or alcohol, powder metal valve seat inserts for internal combustion engine heads often are often inadequate. Powder metal valve seat inserts, when used for intake valve seats and alternate-fuel engines, often contain too little self-lubricant, such as lead, and thus prematurely wear severely. Lead is also undesirable as an embedded self-lubricant since it can foul catalytic surfaces used in treating emissions.

The prior art has not attempted to use thermal spray-forming techniques to make high-performance inserts. The Osprey spraying technique uses a refractory tundish to supply a stream of molten metal which is atomized under inert atmosphere or vacuum to spray-form bulk materials; however, difficult and exacting procedures are necessary to control the molten bath and stream, thus limiting its use to making inserts economically.

SUMMARY OF THE INVENTION

It is an object of this invention to provide a technique to fabricate high-performance inserts that not only are more economical but are not limited in chemistry or not limited in the ability to incorporate ceramic materials. It is a further object of the process to provide making improved insert articles that have a higher hardness and a greater thermal resistance to meet the greater demands of alternatively-fueled engines.

The method of this invention that meets the above objectives is a method of making seat inserts by thermally spraying bulk material, the method comprising the steps of: (i) preparing a mandrel having an outside dimension not greater than the desired inside dimension of the insert, the mandrel having means to provide for separation of the bulk material from the mandrel after it is deposited as a bulk material, (ii) directing the thermal spraying of separate particles of one or more steels or nickel alloy in the presence of a controlled oxidizing medium to form the bulk material as a composite on the mandrel with a density of at least 99% and, (iii) allowing the bulk material to cool; and (iv) removing such bulk material composite from the mandrel and slicing it into discrete seat insert shapes for implanting into a final product.

DETAILED DESCRIPTION AND BEST MODE

Figure 1:
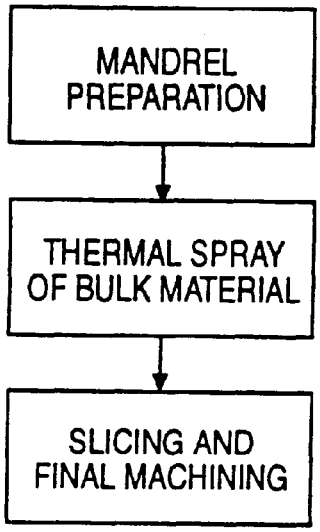
FIG. 1 is a schematic block diagram of the inventive method herein.

The first step of this invention (as diagrammed in FIG. 1) is that of preparing a mandrel 10 having an outside dimension 11 not greater than the desired inside dimension 12 of the designed insert to be fabricated. To make valve seat inserts for internal combustion engine heads, a tapered aluminum hollow tube 13 is used as the mandrel; the tube has a wall thickness 14 of about 0.25–0.50 inches and a surface finish of about 6–8 micrometers Ra. The mandrel is preferably rotated about its own central axis 15 at a speed in the range of 20–60 revolutions per second. Apparatus 16 is provided to pass cooling air or liquid through the interior of the tube at a flow rate of about 20–100 cfm during the thermal spray step. The aluminum alloy of which the tube is made, has a distinctly different thermal expansion characteristic than the bulk sprayed material 17 to facilitate eventual release of the mandrel 10 from the bulk material. The taper 18 of the tube outer surface is preferably about 2–3°, which serves to initiate debonding between the sprayed bulk material and the mandrel upon cooling, the tube shrinking at a greater rate; as further cooling continues the initiated delamination, due to the taper, propagates throughout the axial length 19 of the bulk material to promote a full release. Other materials may be used for the mandrel, such as copper alloys or elemental iron, all being of a higher coefficient of thermal expansion than the deposited bulk material. An assembled mandrel that permits instantaneous release of the insert is also possible.

Figure 2A:
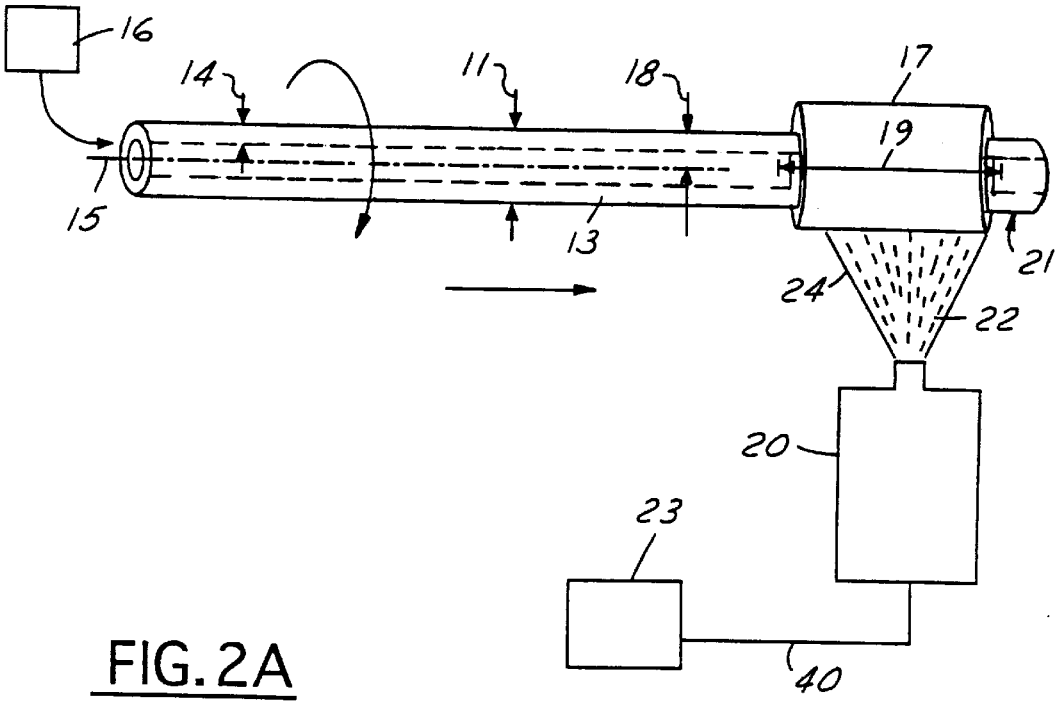
FIG. 2*a* is a schematic illustration of one apparatus mode for carrying out the thermal spraying step of this invention and FIG. 2*b* is an alternative mode.
Figure 2B:
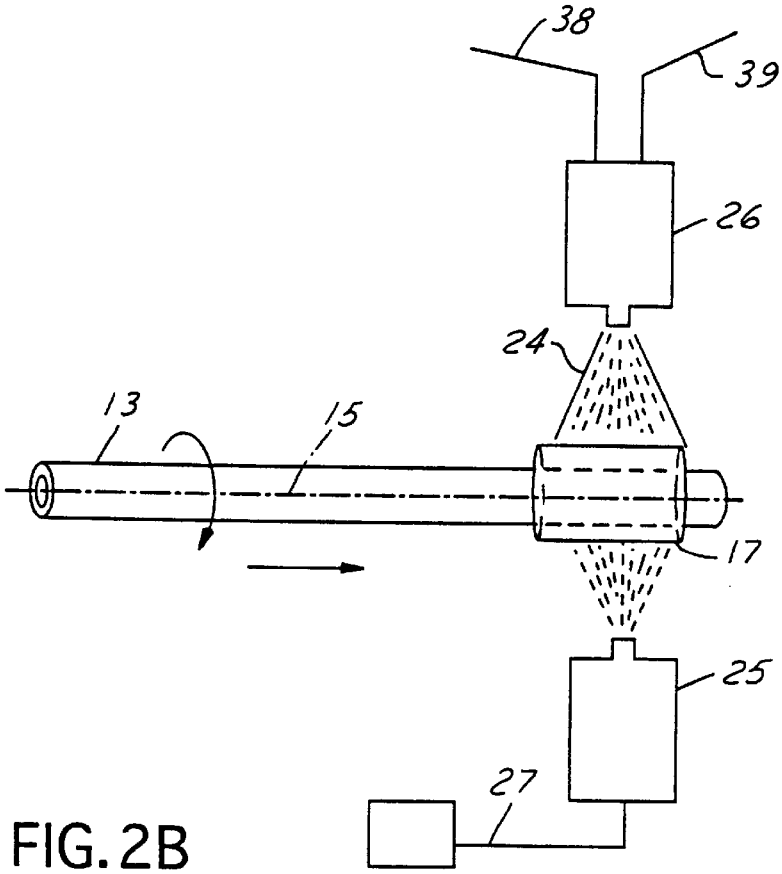

The second step requires thermal spraying of the bulk material onto the rotating mandrel 10. This uniquely creates or forms a sleeve of metal/oxide composite bulk material 17, as shown in FIGS. 2*a* and 2*b*. The thermal spray technique may be wire arc, powder plasma, oxy-fuel, or any of the high veloocity methods such as HVOF or detonation gun. The thermal spray gun has a spray head 20 advantageously placed about 6–12 inches from the target mandrel surface 21. As the mandrel rotates, the thermal spray gun emits a spray 22 of molten droplets that coats the mandrel at a rate of about 2–10 lbs/hr. By repeatedly translating the gun back and forth across the length 19 of the mandrel (3–4 inches or more typically), a coating thickness 32 of about ⅛–¼ inch can be built up in about 15 minutes. Alternatively, the mandrel may be moved through a spray forming station in which several spray guns apply the coating to the work piece.

The selection of the chemistry for the wire or powder feed supply 23 to the gun, to carry out thermal spraying, is less inhibited than that for powder metallurgy or the Osprey process. Novel self-lubricating composite structures may be produced by (a) constituting the feed material 23 of steel or nickel alloy and (b) shrouding the sprayed hot molten droplets in a controlled air or oxygen atmosphere 24, to produce certain self-lubricating oxides of steel or nickel while the droplets are still in transit to the target or during the initial impact with the target. Details as to how to achieve the creation of self-lubricating oxides is taught in U.S. Pat. No. 5,592,927, the disclosure of which is incorporated herein by reference.

It is advantageous if the material supply is selected from the group of: (i) low carbon steel and FeO lubricant (2–15 wt. %); (ii) low carbon steel and high carbon steel and FeO lubricant (2–20 wt. %); and (iii) high carbon steel and nickel alloy, plus iron or nickel oxides. The low carbon steel may be a 1010 steel (such as a single wire feed 40 as shown in FIG. 2*a*) having a composition of by wt. % 0.1 C; 0.6 Mn; 0.045 P; 0.04 S; and the balance iron. The resulting spray-formed seat will consist of an iron alloy matrix inside of which is dispersed Fe oxides. The oxide content will vary between 2–15 wt. % depending on the nature of the propelling gas (air or nitrogen) that is used during the spray. The porosity of the deposited material 17 will be extremely low (2% or less); the inserts will have a hardness of 25–32 Rc and can be readily used in gasoline engines. The second material may be applied by a use of two different wires that are fed into a two wire arc spray gun 20, (as shown in FIG. 2*b*) the first wire 38 being the 1010 steel, and the second wire 39, being a high carbon steel having a composition of about 1.0 C, 1.6–2.0 Cr, 1.6–1.9 Mn, and the balance iron. The gun can be operated under a power of about 25–30 volts, 100–250 amps and a 60–100 psi air pressure. The seat inserts formed in this case will have a hardness value ranging from 35–42 Rc (depending on the spray condition) with the oxide content being 2–20 wt. %. The third selection uses a high carbon steel wire as indicated above and a nickel based alloy wire containing 58% nickel, and 4% Nb, 10% Mo, 23% Cr and about 5% iron; the wires are fed as separate wire feed stocks in a two wire arc system, with the gun operated at a voltage of about 30–33 volts, 200–330 amps and 60–100 psi of air or nitrogen pressure. The inserts produced with the third selection comprises various phases of nickel, iron, $Fe_3O_4$, NiO, FeO and has hardness values ranging from 40–50 Rc.

Copper may be introduced into the spray formed valve seat inserts to increase the thermal conductivity and ability to extract heat from the valve. Spray-formed inserts can have copper incorporated into the microstructure using another flame spray gun 25 (as shown in FIG. 2*b*) to co-deposit the copper along with the deposit from the two wire arc gun 26 as referred to above; the additional flame spray gun 25, of course uses a powder copper feed stock wire 27. The amount of copper can be precisely controlled by adjusting the flame spraying parameters.

Figure 3:
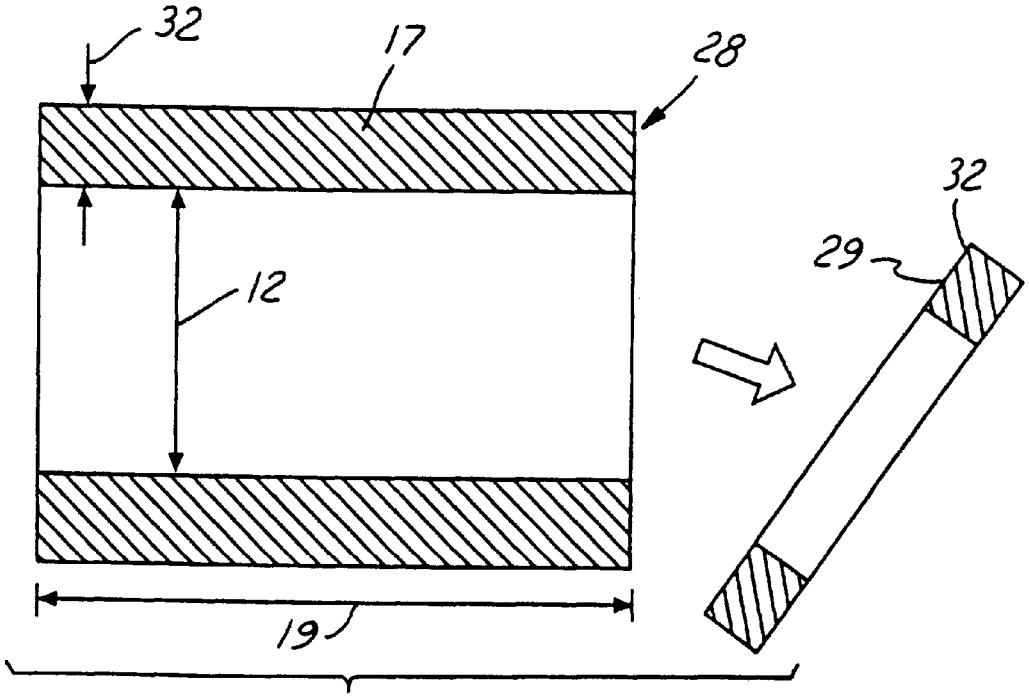
FIG. 3 is an enlarged view of a cylindrical bulk deposit made by this invention, the deposit being sliced into individual seat inserts.
Figure 4:
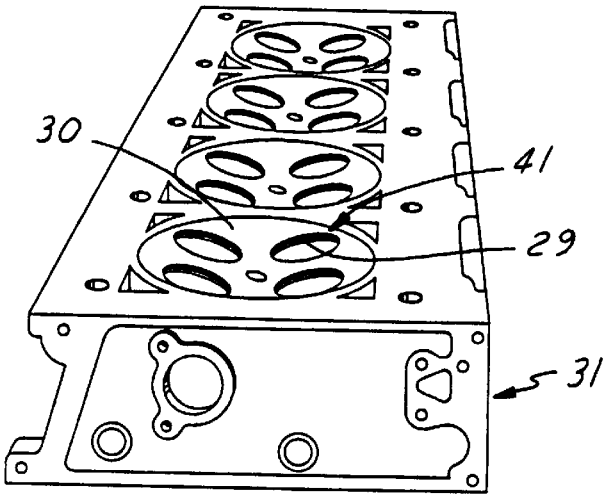
FIG. 4 is a perspective view of an engine head showing seat inserts in place at the intake and exhaust ports.
Figure 5:
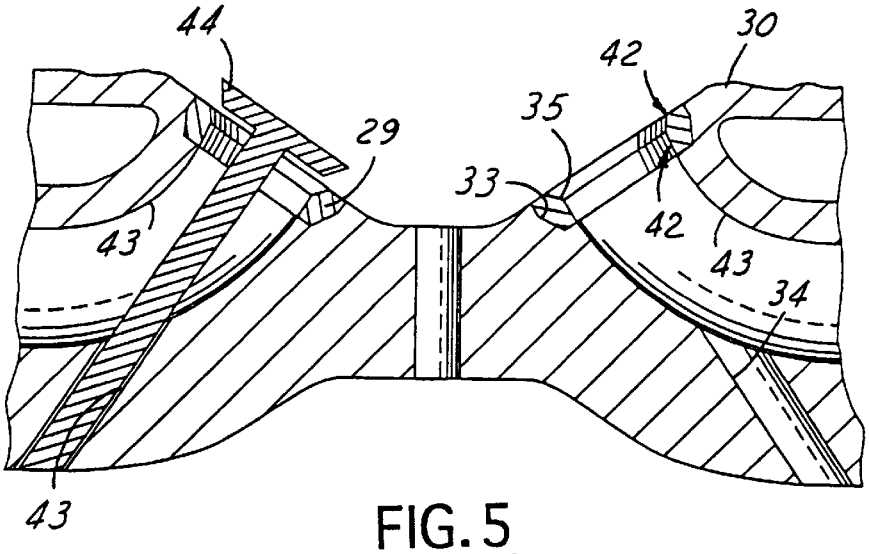
FIG. 5 is a fragmentary sectional elevational view of a portion of an internal combustion engine head assembly, showing how implanted valve seats, made by this invention, function.

The last elemental step of the process is to cool the sprayed bulk material 17 to separate it from the mandrel 10 and slice the sleeve 28 into rings 29 (see FIG. 3) that are inserts to be implanted into the wall 30 of an exhaust or intake port 41 of an aluminum engine head 31, such as shown in FIGS. 4 and 5. The ends or edges 32 of the ring inserts 29 have about a 90° angle as a result of being sliced. These inserts are press-fit or shrunk fit into a complimentary machined groove or slot 33 in the wall of the head; the implanted insert 29 and wall are then machined together to provide a contour 42 that is shaped to the curved wall of the intake or exhaust passage 43 as shown. Usually, the valve guide 34 immediately above the valve opening 35 with the seat insert are simultaneously machined to make sure that the valve guide 34 and valve seat 29 are in absolute alignment to allow the valve 44 to function properly.

Other mandrel release mechanisms may be utilized in addition to that previously described. For example, the mandrel may be made of steel and coated with zinc or tin so that, upon spraying, the initial deposit will not be attached directly to the steel; the copper or zinc is in situ melted during the spraying process to assure a release. The mandrel can also be made of steel and wasted after the thermal spray step has been completed by destructively machining the mandrel out of the sprayed combination. Alternatively, the mandrel may be formed of a dissolvable salt which, after spraying, can be eliminated by dissolution.

Figure 6:
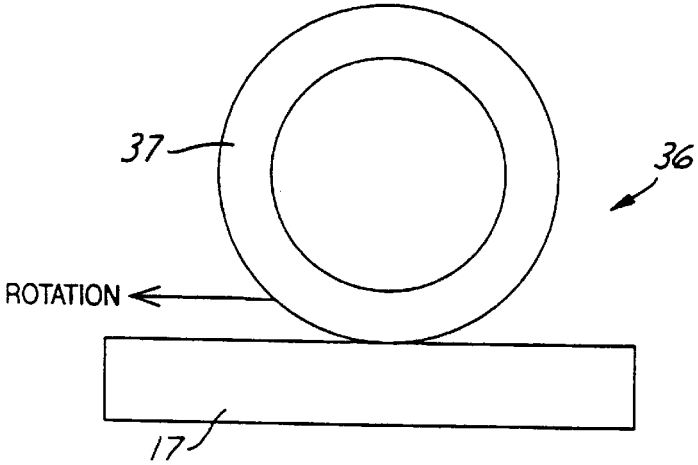
FIG. 6 is a schematic illustration of a wear test apparatus used to determine the wear characteristic of the seat inserts produced by the inventive method.

As shown in FIG. 6, various insert materials were evaluated using a block-on-ring tester 36. A counterface ring 37 of AISI 4620 hardened steel is rotated at 100 rpm under an applied force of 40 newtons against a quantity of the deposited material 17 which has been sprayed on a substrate. Wear resistance is determined by measuring the wear volume of the hardened steel ring after about 30 minutes of testing using a 3 dimensional profilometer. The results of this test show that there is less seat recession or wear than that with powder metallurgy inserts or other equivalent prior art inserts. Such reduction in seat recession is due to the increased wear resistance and self-lubrication of the seat insert, there being less need for any adjustment of the valve lash of the engine after a predetermined period of use thus avoiding the need for continual valve train maintenance.

The material applied by the technique of this invention was also tested in comparison to a standard production insert in a single cylinder engine. An air cooled 4-valve engine capable of delivering 62 hp/liter was fitted with two inserts (1 exhaust and 1 intake) made of the third selected material above. The other seat inserts were made of powdered steel, characteristic of the prior art. The single cylinder engine was operated at 6200 rpm wide open throttle for 99 hours. The wear results showed that the sprayed insert of this invention had considerably less dimensional change than that for the other comparative inserts.

High alloy inserts made for alternate fuel engines have a cost factor of about 6× that of powder metallurgy steel. Using the method of this invention, the cost of producing a valve seat insert for the same application is less than ½ such costs.

Figure 7A:
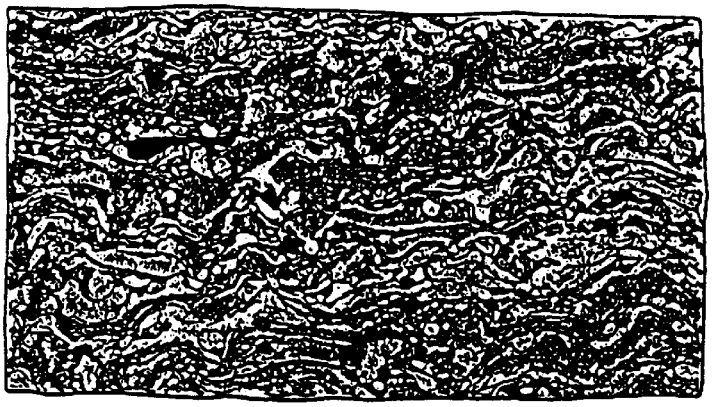
FIGS. 7*a* and 7*b* are micrographs of the microstructure of an inventive spray-formed insert and a powder metallurgy insert respectively.
Figure 7B:
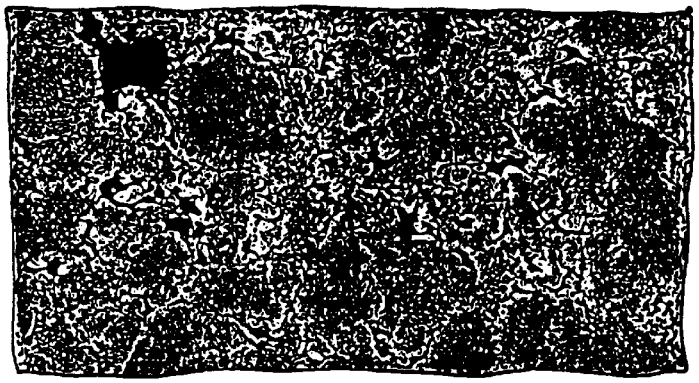
Figure 8A:
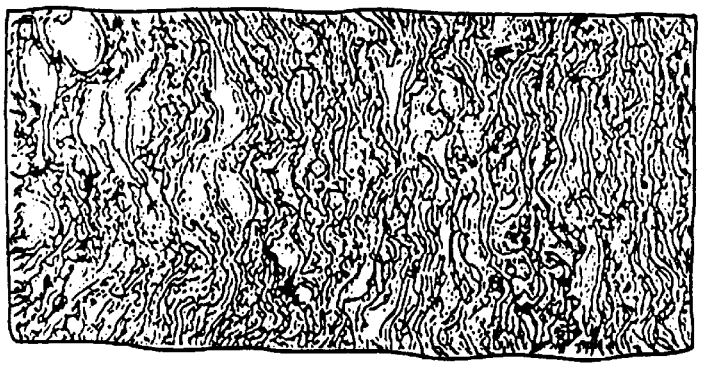
FIG. 8*a* and 8*b* are respectively photomicrographs of an inventive spray-formed copper-infiltrated insert and a copper infiltrated powder metal insert.
Figure 8B:
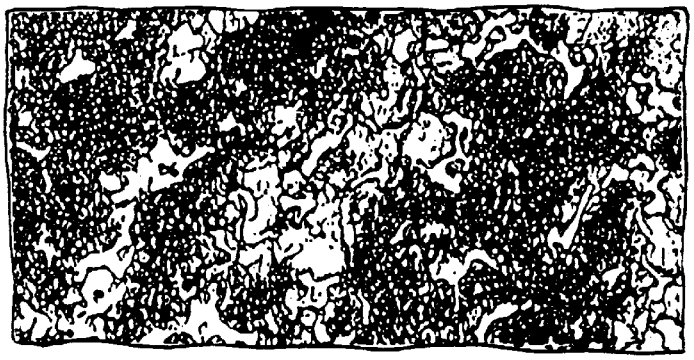

FIGS. 7*a* and 7*b* compare the microstructures of a spray-formed seat insert by this invention with a powder metallurgy insert of the prior art (the micrographs are at 200× magnification). The chemistry of the deposit is FIG. 7*a* is 0.3–0.6 wt. % C, 10–15 Cr, 0.8–1.2 Mb, 25–30 Ni, 1.5–1.5 Nb, 2–5 Mo, 10–20 Fe, 10–15 $Fe_3O_4$ (magnetite) and 2–5 FeO (wuestite) and 5–10 Cu.; the chemistry of the powder metallurgy material in FIG. 7*b* is 0.1–0.7 wt. % C, 0.8 Mo, 6 Cu, others 1–2, bal Fe. FIGS. 8*a* and 8*b* compare photomicrographs (200×) of deposition spray-deposit per this invention containing copper and a copper infiltrated powder metallurgy insert. Such comparison illustrates that effectively high levels of codeposited copper may be produced by the spray-forming process.

While particular embodiments of the invention have been illustrated and described, it will be obvious to those skilled in the art that various changes and modifications may be made without departing from the invention, and it is intended to cover in the appended claims all such modifications and equivalents as fall within the true spirit and scope of this invention.

We claim:

1. A method of making a seat insert having a desired inside dimension by spraying bulk material, comprising the steps of:

(a) preparing a mandrel having an outside dimension not greater than the desired inside dimension of the insert, the mandrel having means to provide for separation of said bulk material from the mandrel after it is deposited as a bulk material;

(b) directing the thermal spraying of separate particles of one or more types of steels or nickel alloys in the presence of a controlled atmosphere to form said bulk material as a composite on the mandrel with a density of at least 99%;

(c) allowing the bulk material to cool; and (d) removing said bulk material composite from the mandrel and slicing it into discrete seat insert shapes for implanting into a final product.

2. The method as in claim 1, in which thermal spraying is carried out by wire arc spraying with a controlled air shroud to promote in-situ formation of FeO.

3. The method as in claim 1, in which the final product is an aluminum alloy engine head, the seat insert forming a valve seat for such head, said bulk material having a chemistry selected from the following groups with a weight percentage for a lubricant associated with a selected group:

(a) low carbon steel and FeO lubricant (2–15 wt. %);

(b) low carbon steel and high carbon steel and FeO lubricant (2–20 wt. %); and (c) high carbon steel and nickel alloy and iron or nickel oxides.

4. The method as in claim 3, in which said bulk chemistry is modified by co-deposition of copper.

5. The method as in claim 1, in which the mandrel is a cylindrical member rotated relative to the direction of the sprayed particles to build said bulk material as a multiple coating on said mandrel.

6. The method as in claim 5, in which the mandrel is a hollow tube through which air is passed to control the temperature of the mandrel and control cooling of the deposited bulk material.

7. The method as in claim 6, in which the mandrel has an outer diameter that is uniformly tapered along the axis of the tube, the taper being in the range of 1–3°, so that upon cooling, the bulk material and mandrel are released at least at one end from the bulk material.

8. The method as in claim 5, in which the mandrel is aluminum.

9. The method as in claim 1, in which the mandrel is comprised of a material having a thermal expansion characteristic greater than the bulk material being sprayed so that, upon cooling from thermal spray temperatures, the bulk material releases from the mandrel.

10. The method as in claim 1, in which said the mandrel is formed of a dissolvable or meltable material that resists the temperature of the thermally sprayed deposit but which can be easily released from the bulk material.

11. The method as in claim 10, in which said the dissolvable or meltable material is zinc or tin.

* * * * *